United States Patent [19]

DuBois et al.

[11] Patent Number: 4,674,735

[45] Date of Patent: Jun. 23, 1987

[54] AUTOMATIC SHEET FEEDER FOR COPIERS AND OTHER MACHINES HAVING SHEET TRANSPORT MECHANISMS AND ASSEMBLIES THEREWITH

[75] Inventors: R. Clark DuBois, 332 Wakeman Rd., Fairfield, Conn. 06430; Robert K. Streeter, Jr., Bridgeport, Conn.

[73] Assignee: R. Clark DuBois, Fairfield, Conn.

[21] Appl. No.: 755,682

[22] Filed: Jul. 16, 1985

Related U.S. Application Data

[63] Continuation-in-part of Ser. No. 559,081, Dec. 7, 1983, abandoned.

[51] Int. Cl.[4] ..... B65H 5/06

[52] U.S. Cl. ..... 271/10; 271/111; 271/116; 271/122; 271/246; 271/274

[58] Field of Search ..... 271/110, 111, 114, 116, 271/122, 246, 273, 274, 9, 10

[56] References Cited

U.S. PATENT DOCUMENTS

| | | | |
|---|---|---|---|
| 2,468,193 | 4/1949 | Goff . | |
| 2,626,029 | 1/1953 | Gutterman . | |
| 2,655,374 | 10/1953 | Townsley . | |
| 2,892,629 | 6/1959 | Osgood, Jr. et al. . | |
| 3,044,770 | 7/1962 | Brevers . | |
| 3,108,801 | 10/1963 | Van Dalen . | |
| 3,272,500 | 9/1966 | Van Dalen et al. . | |
| 3,754,754 | 8/1973 | Peterson . | |
| 3,857,559 | 12/1974 | McInerny . | |
| 3,861,670 | 1/1975 | Kraft . | |
| 3,861,671 | 1/1975 | Hoyer . | |
| 3,957,366 | 5/1976 | Taylor et al. . | |
| 3,961,786 | 6/1976 | Yanker . | |
| 4,060,232 | 11/1977 | Gibson . | |
| 4,368,881 | 1/1983 | Landa . | |
| 4,465,272 | 8/1984 | Kijita et al. . | |
| 4,605,218 | 8/1986 | Knepper | 271/274 X |
| 4,627,607 | 12/1986 | Ishii | 271/274 X |

FOREIGN PATENT DOCUMENTS

| | | |
|---|---|---|
| 053035 | 6/1982 | European Pat. Off. . |
| 1391571 | 4/1975 | United Kingdom . |
| 1420844 | 1/1976 | United Kingdom . |
| 1492462 | 11/1977 | United Kingdom . |
| 1492507 | 11/1977 | United Kingdom . |
| 2041887 | 9/1980 | United Kingdom . |
| 2058020 | 4/1981 | United Kingdom . |
| 2069982 | 9/1981 | United Kingdom . |
| 2099369 | 12/1982 | United Kingdom . |

OTHER PUBLICATIONS

IBM Technical Disclosure Bulletin, vol. 22, No. 12, May 1980—Cochran, et al., (4 pages).

*Primary Examiner*—Richard A. Schacher

[57] ABSTRACT

An automatic sheet feeding device cooperates with a copying apparatus or the like for advancing a single sheet to be copied from a stack of sheets. A sheet drive mechanism of the sheet feeding device feeds the sheets into an entrance end of a feeding device of the sheet processing apparatus. A cover is pivotally mounted on the sheet feeding device and cooperates with a roller separating device to facilitate the clearing of sheet jams. A provision is made to allow removal and replacement of rollers of the sheet drive mechanism.

12 Claims, 26 Drawing Figures

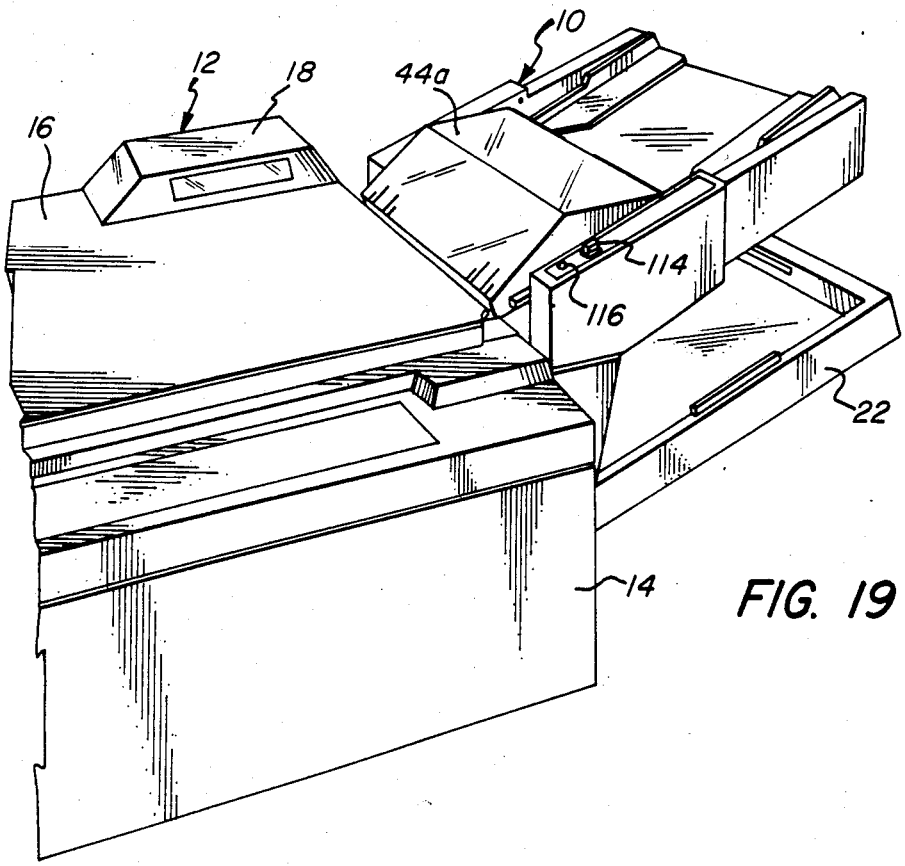
FIG. 19
FIG. 20
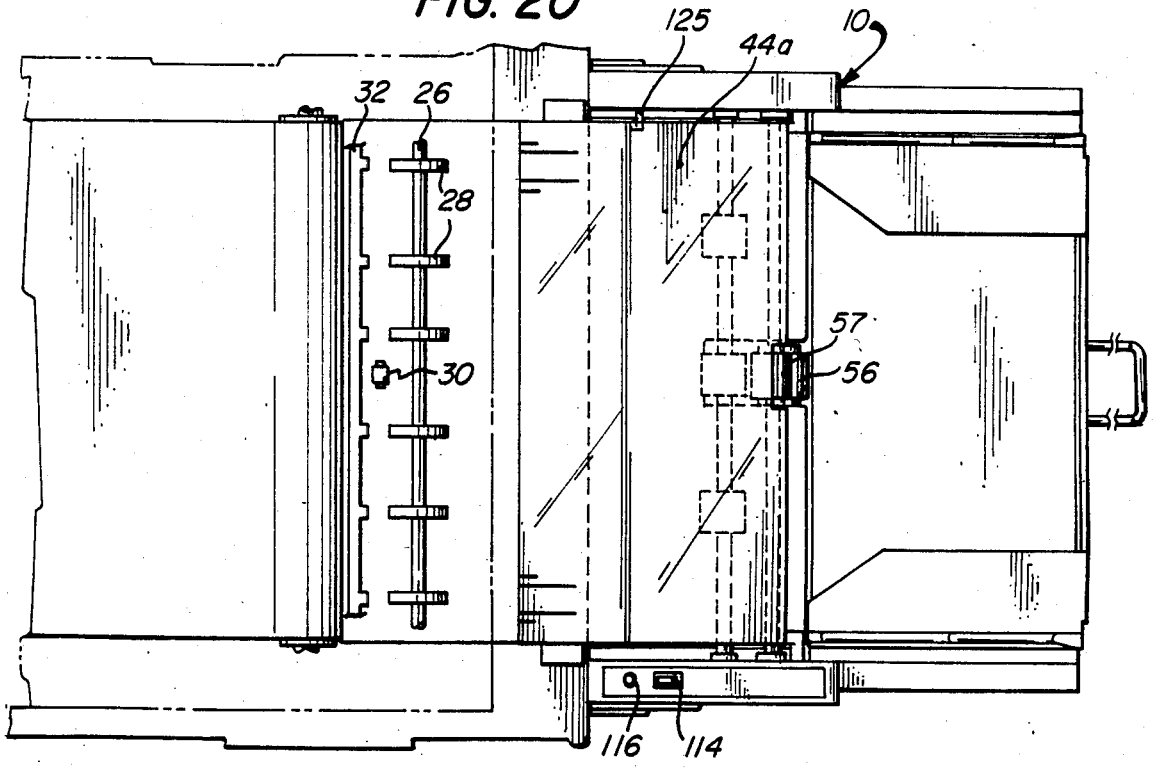

AUTOMATIC SHEET FEEDER FOR COPIERS AND OTHER MACHINES HAVING SHEET TRANSPORT MECHANISMS AND ASSEMBLIES THEREWITH

RELATED APPLICATIONS

This application is a continuation-in-part of application Ser. No. 559,081 filed Dec. 7, 1983 now abandoned.

FIELD OF THE INVENTION

The present invention relates generally to an automatic sheet feeding device, and more particularly, to an automatic sheet feeding device for feeding sheets into copiers and other machines.

BACKGROUND OF THE INVENTION

Many business machines including copying apparatus have sheet feeding or transport mechanisms and assemblies therewith which operate semi-automatically, and the operator must manually insert each sheet being processed into an entrance end of the transport mechanism to be engaged and transported by the sheet transport mechanism through the work station. Since this manual feeding procedure is extremely time consuming and causes considerable delay, it would be desirable to have the sheets automatically inserted into the entrance end of the transport mechanism.

The term "sheet" as contemplated by the present invention is used to describe a single unprinted sheet, an original document, or a folded sheet such as an envelope.

"Sheet material" as used herein refers to paper, synthetic resin, metal foil and laminates.

SUMMARY OF THE INVENTION

Typically, the entrance to the semi-automatic sheet processing apparatus has a gate which is normally down, and a sheet detecting apparatus normally of a photoelectric nature which will detect when a sheet is present at the gate. When the detector detects a sheet at the gate, a solenoid is energized which brings into engagement a feed roller with a mating idler and also raises the gate, so that the feed roller may present the sheet to the processing apparatus.

An automatic sheet feeding device embodying the invention cooperates with this existing mechanism to automatically feed sheets to the processing apparatus. An automatic sheet feeding device embodying the invention includes a frame adapted to be mounted to a copier and includes an inclined sheet tray supported on the frame of the copier, adapted to hold a stack of sheets. The automatic sheet feeding device further includes first and second pairs of rollers. The first pair of rollers define a nip which will receive sheets from the stack of sheets to be fed to the sheet processing apparatus; while the second set of rollers define a nip which will accept a sheet from the first pair of rollers and present it to the gate of the sheet processing apparatus. Both sets of rollers are driven from a single motor through a gear train and the speed of the second set of rollers may be substantially greater than that of the first set. The first set of rollers also provide a sheet separating function in the event that more than one sheet attempts to pass the nip of the first set of rollers at the same time.

In the first set of feed rollers, the top roller is directly driven by the motor, and the second is driven through a slip clutch through the aforementioned gearing. Both of the rollers of the first set are rubber or a derivative thereof, and it will be understood that the coefficient of friction between rubber and rubber, or between rubber and paper, is much greater than that of paper and paper. Therefore, the clutch on the lower roll is adjusted to slip should two or more sheets enter into the nip defined by the first set of rollers. The lower roller of the first set is driven by driving contact with the upper driven roller which is rubber to rubber friction contact, and the slip clutch will slip relative to its gear drive. Under normal conditions of operation, a single sheet on top of the stack to be fed will be gravity fed into contact with the nip defined by the first set of rollers and the single sheet will transmit a sufficient frictional force on the lower roller to rotate the lower roller through the rubber to paper friction contact, as the friction clutch slips relative to the drive gear. However, if two sheets are fed simultaneously between the first pair of rollers, the paper to paper friction contact between the two sheets is too small to overcome the frictional force between the friction clutch and its drive gear, and thus, the friction clutch engages the lower roller shaft to reverse the rotation of the lower roller and drive the bottom sheet of two sheets backwardly along the feed path onto the stack of sheets.

The second set of rollers than pulls the presented single sheet and applies it to the gate of the copier or other sheet feeding device. When a sheet is presented to the gate of the copier, it is detected by the photodetector and through circuit logic, the drive motor for the automatic sheet feeder is deenergized. When the gate is raised and the previously fed sheet goes to the processing station of the copier, the photodetector senses the trailing edge thereof and applies a signal to the logic of the automatic document feeder which, in essence, states that another sheet can now be fed to the copier. This, then, causes the automatic document feeder motor to be energized to feed another sheet. Thus, the automatic document feeder is so arranged that it will only feed a sheet when it is sensed that there is no sheet present at the gate to the copier.

The logic of the automatic document feeder will, in conjunction with the sheet detector of the copier, sense when the stack of sheets in the automatic document feeder has been exhausted and will then turn off the automatic document feeder.

It is an object of the this invention to provide a new and improved automatic document feeding device for sequentially advancing each sheet of a stack of sheet material into engagement with a sheet feeding or transport mechanism of a business machine and thereby increase the efficiency of the machine and its operator.

It is another object of the invention to provide such a device which will be powered and controlled by the associated machine so as to operate synchronously therewith.

It is another object of the invention to provide such a device which permits easy clearance of sheet jams and avoids damage to the sheets being processed.

A further object of the invention is to provide such an automatic sheet feeding device which may be readily fabricated and will enjoy long life in operation.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

BRIEF DESCRIPTION OF THE DRAWINGS

FIG. 19 is a view similar to FIG. 1 of a machine embodying the invention but with a different cover on the automatic document feeder;

FIG. 20 is a plan view of the automatic document feeder of FIG. 19;

DETAILED DESCRIPTION OF THE PREFERRED EMBODIMENT

Figure 1:
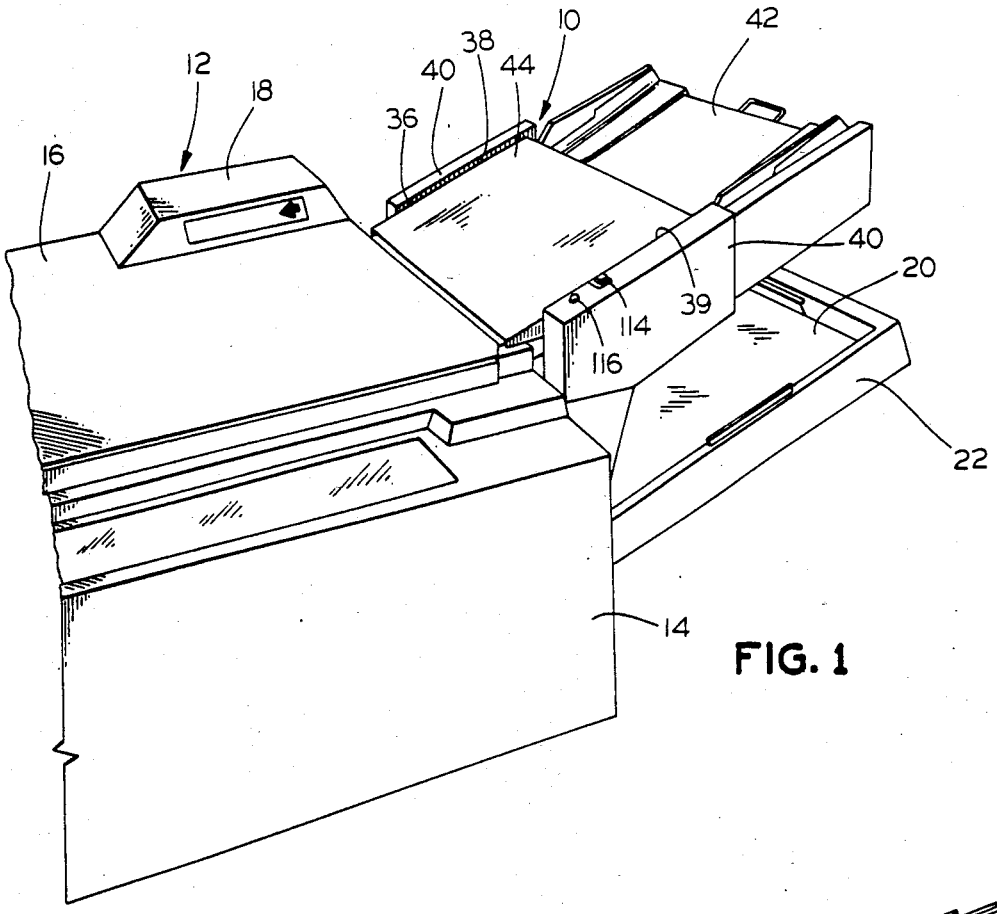
FIG. 1 is a fragmentary perspective view of a copying apparatus with the automatic document feeding device embodying the present invention mounted thereon.

Referring first to FIG. 1, therein is illustrated an automatic document or sheet feeding device embodying the present invention and generally designated by the numeral 10 as mounted on a conventional copying apparatus generally designated by the numeral 12. The copying apparatus 12 has a main housing 14 with a pivotally mounted cover 16 thereon, and contains a copying station (not shown) under the cover 16 and a control circuit 18 to reproduce documents on copier sheet material 20 taken from copier paper tray 22 as the documents are fed through the copying apparatus 12 in a face down orientation.

Figure 18:
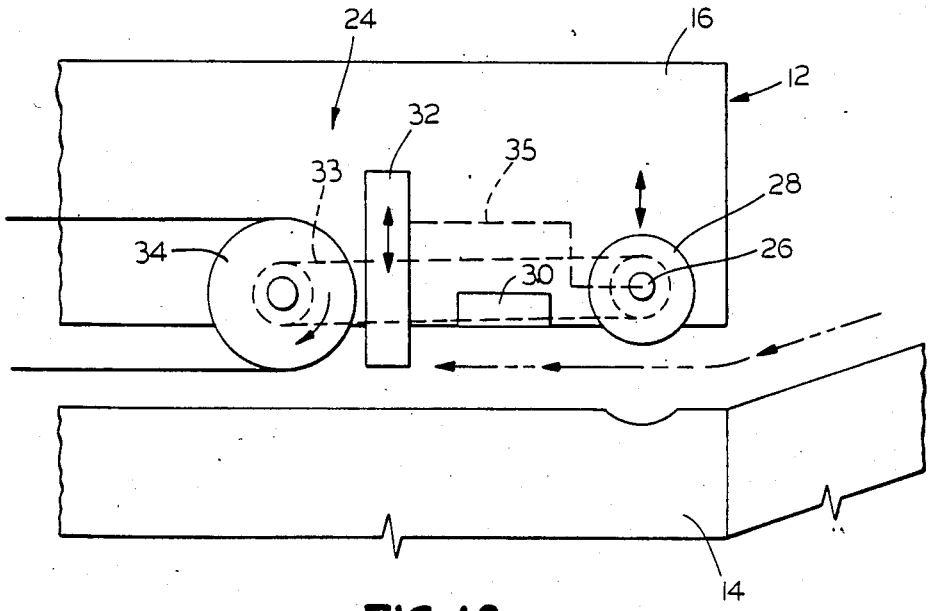
FIG. 18 is a fragmentary side elevational view of the copying apparatus with the cover and housing broken away for clarity of illustration.

As seen in FIG. 18, the cover 16 contains a semi-automatic feeding or transport mechanism generally designated by the numeral 24 and including a shaft 26 having a plurality of pinch rollers 28 thereon, document photosensor 30, entrance gate 32 and main document belt drive 34. The shaft 26 and the plurality of pinch rollers 28 thereon are journalled in the cover 16 and rotatably driven by a drive belt 33 concurrently with main document belt drive 34 as controlled by the copier control circuit 18, and they are mounted for reciprocal vertical movement within the cover 16 for purposes to be explained hereinafter. The document photosensor 30 is located in the travel path after the pinch rollers 28 and detects the presence of a document in position to be fed through the work station by the semi-automatic document feeding mechanism 24. The entrance gate 32 is mounted for vertical movement and is mechanically coupled to the shaft 26 as indicated by phantom line 35. Thus, the entrance gate 32 and the shaft 26 with its pinch rollers 28 will reciprocate in the cover 16 as will be explained more fully hereinafter. The main document belt drive 34 advances the document through the copying station to an exit end of the copying apparatus.

The automatic document feeding device 10 for advancing a single document from a stack of documents to the entrance gate 32 of the copying apparatus 12 has a frame 36 mounted on one end of the copying apparatus 12 above the copier paper tray 22. The frame 36 includes a pair of upstanding side plates 38, 39 and covers 40 removably mounted on the outer side thereof. The frame 36 supports an inclined document tray 42 which holds a stack of documents 85 to be copied, and an inclined document guide 43 to direct the documents being fed from the document feeding device 10 into the entrance end of the copying apparatus 12.

Figure 4:
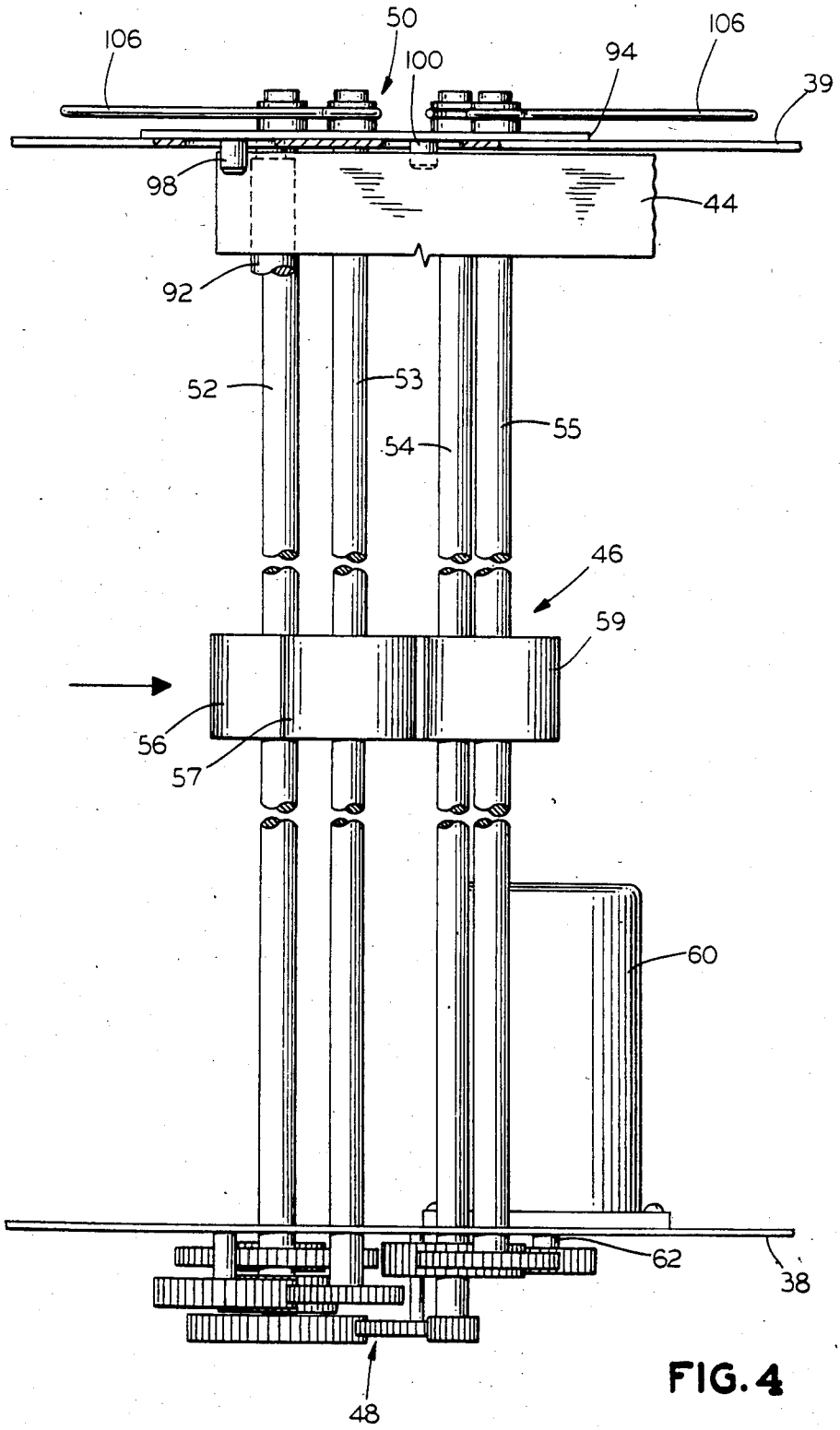
FIG. 4 is a fragmentary top elevational view of the document feeding device with portions removed or in section for clarity of illustration.
Figure 11:
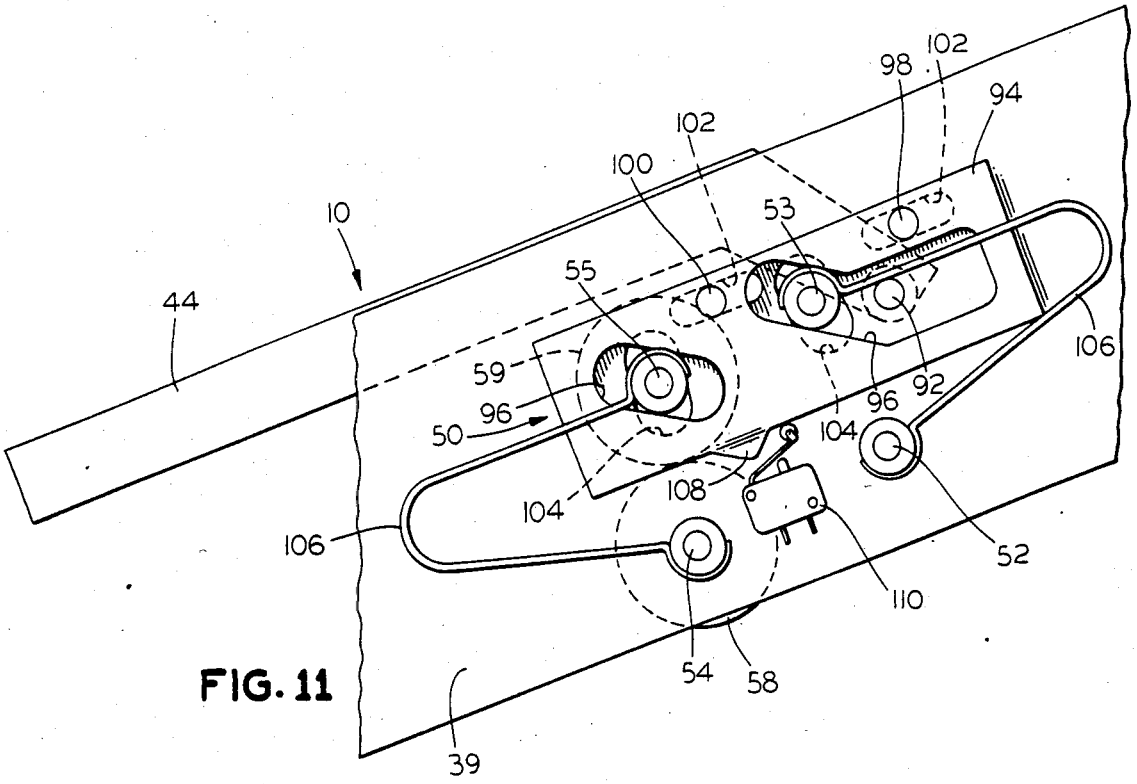
FIGS. 11 and 12 are fragmentary side elevational views of the document feeding device with portions broken away and omitted for clarity of illustration, showing a pair of the feed rollers (in phantom line) and the cover in their closed and open positions, respectively.
Figure 12:
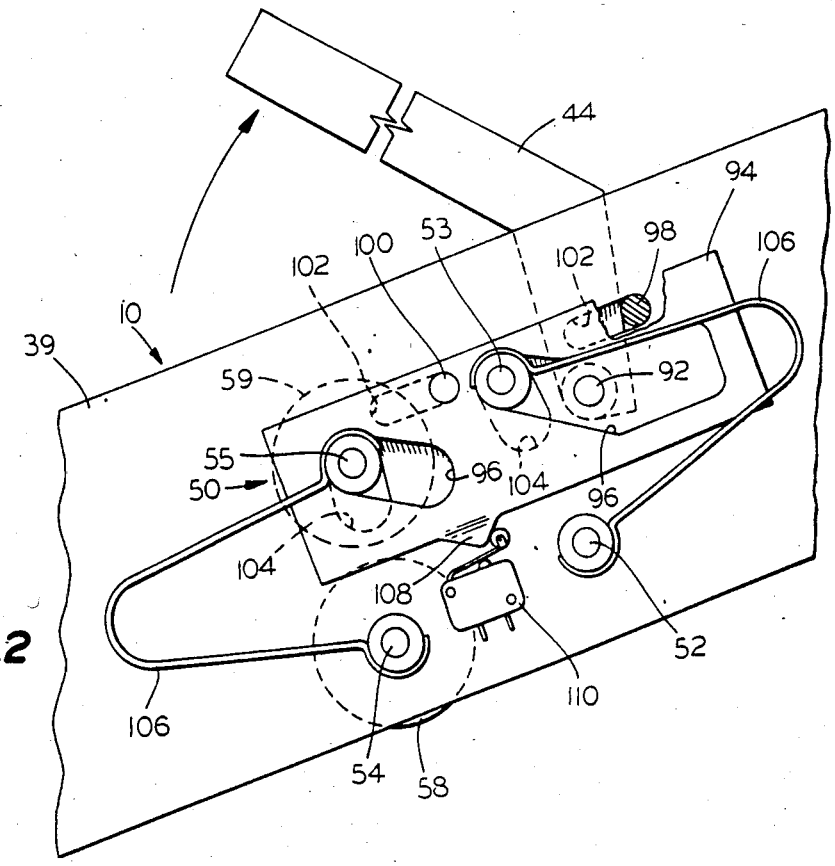
Figure 13:
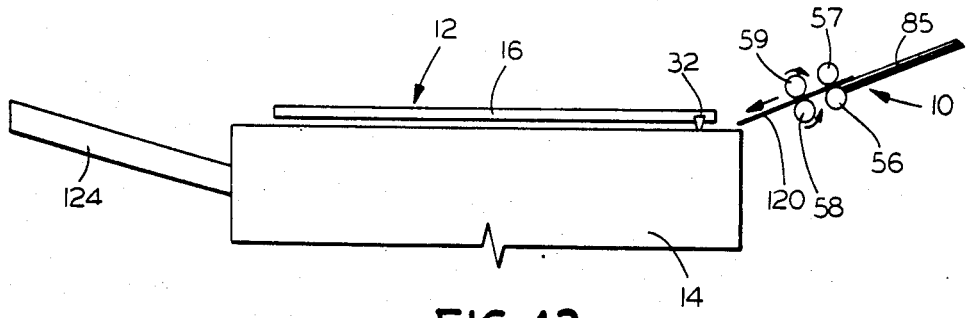
FIGS. 13–16 are schematic diagrams showing the normal operation of the copying apparatus and document feeding device as a sheet is fed from the stack therethrough.

A cover 44 is journalled in the frame 36 for pivotal movement between a closed position and an open position for clearing document jams, as seen in FIGS. 11 and 12. As seen in FIG. 4, extending below the cover 44 is a document drive mechanism for separating and feeding a single document and generally designated by the numeral 46. The drive mechanism includes a gear drive train generally designated by the numeral 48 located outwardly adjacent the side plate 38 and a roller separation mechanism generally designated by the numeral 50 located outwardly adjacent side plate 39.

Figure 5:
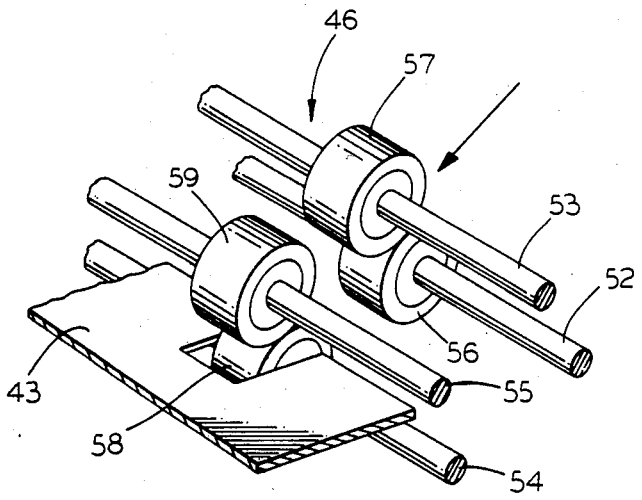
FIG. 5 is a fragmentary perspective view of the feed rollers and document guide of the document feeding device showing their relative positions.

As best seen in FIGS. 4 and 5, a multiplicity of parallel, spaced apart shafts 52, 53, 54 and 55, extend through and are journalled for rotation in the side plates 38, 39. Each of the shafts 52, 53, 54 and 55 has a high friction surface rubber roller 56, 57, 58 and 59 mounted thereon for rotation therewith. It should be noted that portions of the periphery of the lower rollers 56 and 58 are disposed within notches formed in the lower edge portions of inclined document tray 42 and guide 43. Rollers 56 and 57 cooperate to form a nip therebetween which is disposed upwardly of the lower edge of the document tray 42 while rollers 58 and 59 cooperate to form a nip therebetween which is in the feed path therefrom. The distance between rollers 58, 59 and entrance gate 32 is generally seven and one half inches which is less than the length between the leading and trailing edges of the documents to be fed for purposes to be explained hereinafter.

Referring now to FIGS. 4 and 8–10, a motor drive 60 for rotating the gear drive train 48 of the document drive mechanism 46 is mounted beneath document guide 43 on side plate 38. The motor 60 has a shaft 62 which rotates gear 64 which drives the intermeshed gears 66 to rotate the shafts 54, 55 and the rollers 58, 59 thereon. The transfer pinion gear 68 on the lower gear 66 drives idler gear 70 and idler gear 72, which has a transfer pinion gear 73 thereon which in turn drives gear 74 which is rotatably mounted on shaft 52 between a bushing 76 and a slip or friction clutch generally designated by the numeral 78. The transfer pinion gear 75 on the gear 74 drives the idler gear 80 which in turn rotates the gear 82 rotatably mounted on the shaft 53. A one way spring clutch 84 operatively connects the shaft 53 and gear 84 for concurrent rotation but permits freewheeling of the shaft 53 if shaft 53 is driven faster than gear 82. All idler gears in the gear drive train 48 are mounted on stub shafts supported on the side plate 38.

The friction clutch 78 has a pair of bushings 126 and 128 axially slidable on but splined for rotation with the end of shaft 52. A coil spring 130 biases the bushings 126, 128 apart, and the amount of compression of the spring 130 and thus the force exerted by the bushing 126 on the gear 74 can be adjusted by axial movement of the screw 132 which is threadably engaged in the end of the shaft 52. By loosening the screw 132, the outer bushing 128 can move axially outwardly and reduce the compression of the spring. The thrust washer 134 is disposed between the head of the screw and bushing 128.

Figure 6:
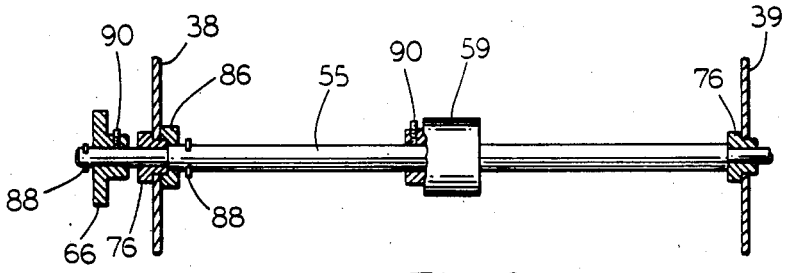
FIGS. 6 and 7 are partially diagrammatic illustrations showing the manner of removal of a feed roller from the document feeding device.
Figure 7:
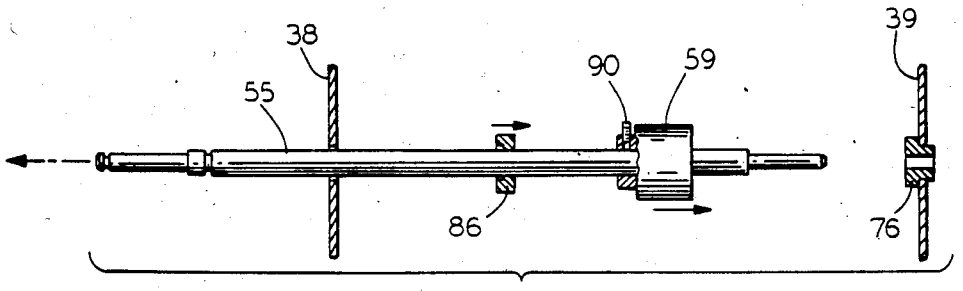
Figure 8:
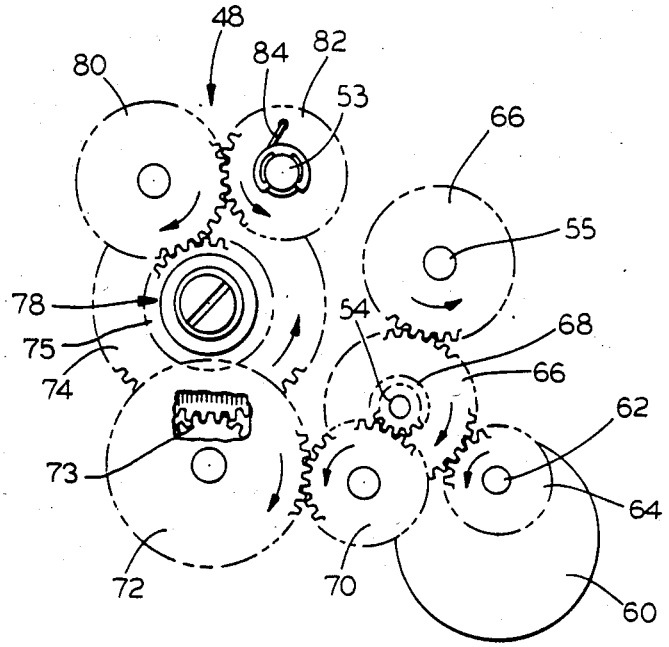
FIG. 8 is a side elevational view of the gear drive train and motor drive of the document feeding device with portions broken away for clarity of illustration.
Figure 9:
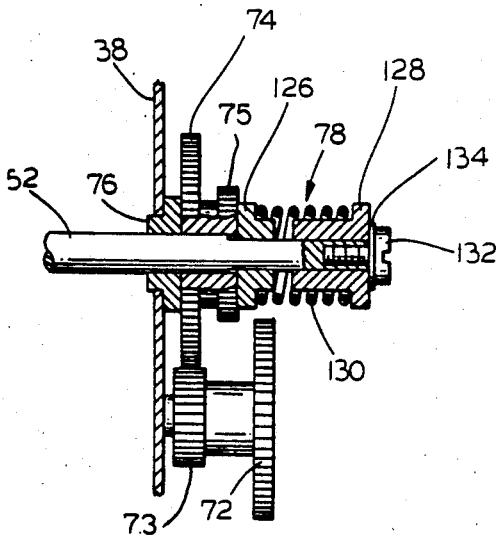
FIG. 9 is a fragmentary end elevational view of the document drive mechanism of the document feeding device with portions in section for purposes of illustration.
Figure 10:
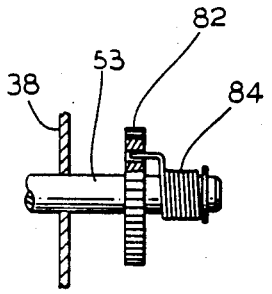
FIG. 10 is a fragmentary end elevational view of the one way spring clutch of the document feeding device.

Turning now to FIGS. 6 and 7, therein illustrated is the mounting of the shaft 55 which is illustrative of that also used for the several shafts 52, 53 and 54. The shaft 55 is journalled in the side plates 38, 39 by bushings 76 and spacer 86 and has C-clips 88 releasably retained thereon to limit axial movement thereof towards the side plate 38. The roller 59 and the gear 66 have set screws 90 releasably retaining them on shaft 55 against relative axial and rotational movement. To remove the shaft 55 and the associated parts, set screws 90 are disengaged and the C-clips 88 are removed to allow shaft 55 to be slid through side plate 38 to be removed therethrough.

As best seen in FIGS. 4, 11 and 12, the cover 44 has a pair of pivot shafts 92 (only one shown) mounted thereto and having a reduced end portion journalled in side frames 38, 39 to allow pivotal movement of the cover 44 between a closed position and an open position for clearing document jams in the feed rollers. As the cover 44 pivots to the open position, the roller separation mechanism 50 moves the roller shafts 53 and 55 to separate the pairs of cooperating rollers 56, 57, 58 and 59. The roller separation mechanism 50 includes a slide plate 94 having a pair of inclined cam slots 96 therein and a pair of studs 98, 100 extending inwardly through the elongated slots 102 in the side plate 39. The shafts 53 and 55 extend through the elongated apertures 104 in the side plate 39 and are disposed in the inclined slots 96 of the plate 94. The ends of the leaf springs 106 bear on the ends of the cooperating pairs of shafts 52, 53, and 54 and 55 normally biasing shafts 53, 55 towards the shafts 52, 54, thereby biasing rollers 56, 57 and 58, 59 into surface contact with one another.

When the cover 44 is pivoted from its closed position (FIG. 11) to its open position (FIG. 12) it bears against stud 98 to slide the plate 94. As the plate 94 moves to the right as seen in FIG. 12, the shafts 53, 55 which are disposed in the inclined slots 96 are moved upwardly in the slots 96 to separate the rollers 57, 59 from the rollers 56, 58. The side plate 38 is provided with a sufficient amount of clearance to allow the shafts 52 and 55 to pivot thereabout as one end of each shaft is moved upwardly by slide plate 94. The gear drive mechanism 48 is also provided with sufficient clearance or play to allow such movement. A cam projection or tab 108 on the slide plate 94 is operatively engageable with the microswitch 110 for disconnecting the supply of power to the motor 60 when the cover 44 is moved to its open position.

Figure 17:
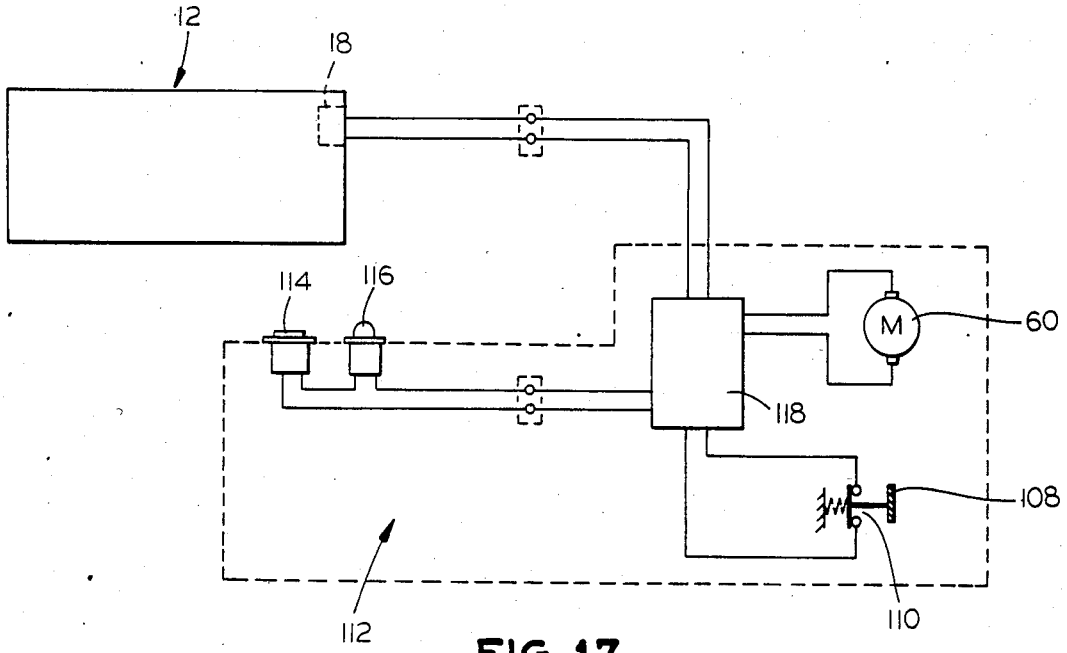
FIG. 17 is a schematic wiring diagram of the document feeding device of the present invention.

As illustrated in FIG. 17, a control circuit generally designated by numeral 112 of the document feeding device 10 controls the supply of power from the control circuit 18 of copying apparatus 12 to the drive motor 60. The manually actuated switch 114 activates light 116 and motor 60 of the automatic document feeding device 10 through the circuit board 118. The cam-operated microswitch 110 deactivates the motor 60 in response to movement of the cover 44 to its open position.

To initiate a copying operation or sequence, the operator simply places the stack of documents 85 in a face down orientation on the document tray 42. Then the operator presses the switch 114 to activate the motor drive 60 to rotate gear drive train 48 illustrated in FIG. 8. It should be noted that the automatic document feeding device 10 can feed a stack of documents 85 having a height which is smaller than or equal to the distance between the upper nip forming portion of lower roller 56 and the plane defined by the top surface of the tray 42, i.e. a stack of approximately thirty documents.

Figure 2:
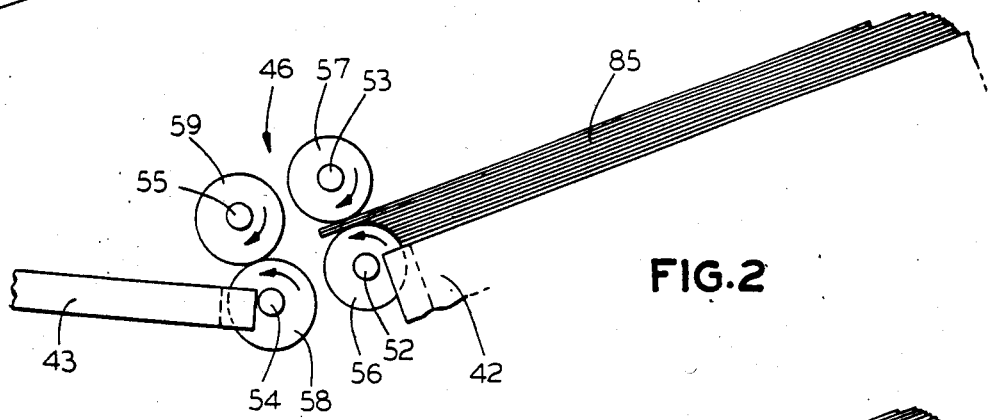
FIG. 2 is a partially diagrammatic side elevational view of the tray and rollers of the feeding device with a pair of sheets in the nip of the feed rollers.
Figure 3:
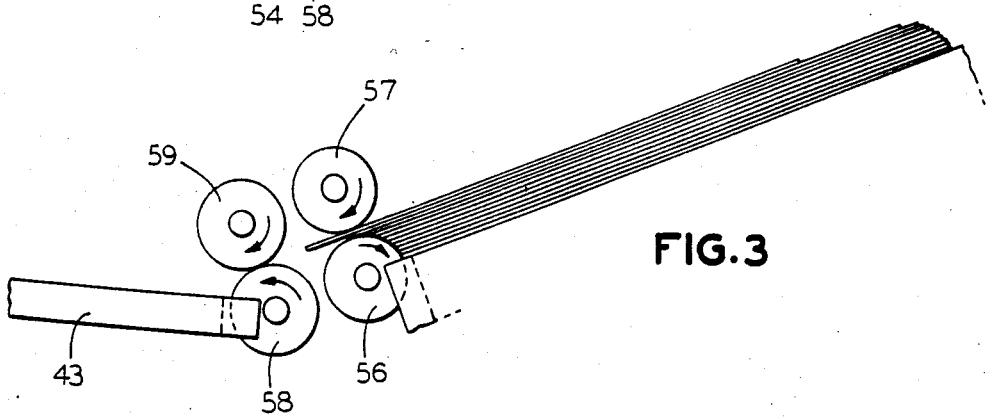
FIG. 3 is a similar view showing the manner in which the feed rollers of the automatic document feeding device returns the lower sheet to the stack of documents.

As seen, FIGS. 2 and 3 illustrate the operation of the document drive mechanism 46 of the document feeding device 10 to feed only a single document from a stack of documents 85 located on document tray 42. It must be understood that the coefficient of friction between rubber and rubber, or between rubber and paper, is much greater than that of paper and paper. The clutch 78 is adjusted to slip should two or more sheets enter into the nip defined by the rollers 56, 57.

When the motor drive 60 is activated, the gear drive train 48 drives rollers 58 and 59 at a surface speed three times faster than that of the roller 57. The roller 56 is driven by driving contact with the rotating roller 57, i.e. the rubber to rubber friction contact, as the friction clutch 78 will slip relative to the gear 74. Normally, a single sheet on the top of stack 85 will be gravity fed into contact with the rotating lower roller 56 and swept thereby into the nip defined by rollers 56, 57 and the sheet driven by upper roller 57 will exert a sufficient force on lower roller 56 to rotate the same through the rubber to paper friction contact, as the friction clutch will again slip relative to the gear 74. However, if two sheets are fed simultaneously between rollers 56 and 57 (FIG. 2), the paper to paper friction contact between the two sheets is too small to overcome the frictional force between the friction clutch 78 and gear the 75. Thus, it will be understood that friction clutch 78 engages the shaft 52 with the gear 75 to reverse the rotation of the roller 56 as seen in FIG. 3 to drive the bottom sheet backwardly along the feed path onto the stack of documents 85. As the bottom sheet leaves the nip between rollers 56, 57, roller 56 engages the single (formerly upper) sheet remaining in the nip. Thereafter, the clutch 78 disengages and roller 56 reverses its direction and cooperates with the roller 57 to feed the sheet to the nip between the second pair of feed rollers 58, 59.

As best seen in FIGS. 13–16, a single document 115 is moved from the stack of documents 85 by the rollers 56, 57. Thereinafter, the document is captured in the nip defined by rollers 58, 59 which have a surface speed three times faster than that of the rollers 56, 57. Hence, the drag of the document through the rollers 56, 57 will produce a force which causes the friction clutch 78 to permit the shaft 52 and roller 57 thereon to freewheel while the one way spring clutch 84 allows shaft 53 and roller 57 thereon to freewheel. The moving document thereby drives the rollers 56, 57 at the higher speed while the leading edge of the document is guided by the inclined document guide 43 into the entrance end of the semi-automatic feeding mechanism.

Figure 14:
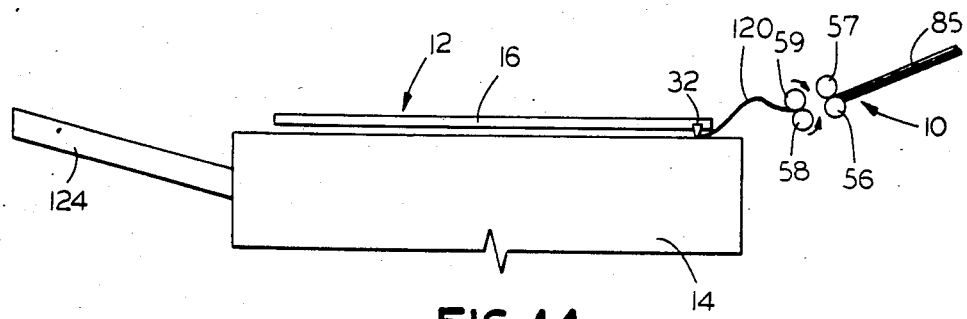

As the document 115 passes the photosensor 30 and contacts the entrance gate 32 of the semi-automatic feeding mechanism 24, the photosensor 30 causes a signal to be sent from the copier control circuit 18 to the automatic document feeding device control circuit 112 to deactivate the motor drive 60. However, the angular momentum of document drive mechanism 46 will continue to rotate the shafts 54, 55 and their rollers 58, 59 for a short period of time to buckle the document 115 as shown in FIG. 14 since the distance from the rollers 58, 59 to the entrance gate 32 is less than the distance between the leading and trailing edges of the document. This buckling insures positive engagement between the leading edge of the document 115 and the entrance gate 32.

The operator must then deactivate a semi-automatic feeding start switch (not shown) in the copier control circuit 18 which activates the semi-automatic feeding mechanism 24. After this activation, the entrance gate 32 is lifted from its position blocking the leading edge of the document 115. Concurrently, the main document belt drive 34 is activated and thereby drives the shaft 26 and the rollers 28 through the drive belt 33. The shaft 26 and the rollers 28 drop into driving contact with the document 115 to push it forwardly to the main document belt drive 34 to feed it through the copying apparatus 12.

Figure 15:
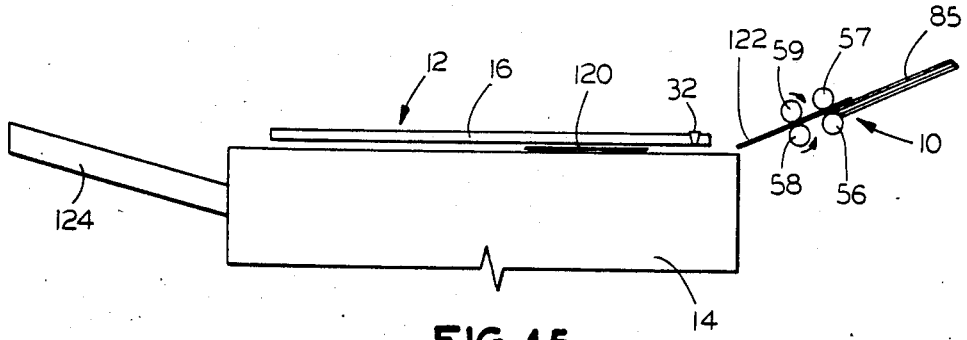
Figure 16:
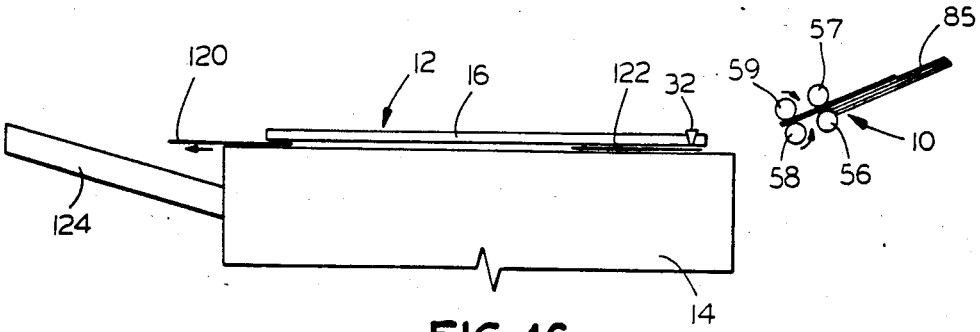

As a result of the activation of the main document belt drive 34, the control circuits 18 and 112 activate the motor 60 and thereby the document drive mechanism 46 to feed another document 122 from the top of stack 85 (FIG. 15). When the photosensor 30 senses the trailing end of the document 115, the entrance gate 32 drops into the feed path and the rollers 28 lift therefrom. As seen in FIG. 16, the automatic document feeding device 10 and the feeding mechanism 24 of the copying apparatus 12 continue to feed the documents from the stack 85 through the copying apparatus 12 to the exit tray 124. When the stack is exhausted, the supply of power from the copying apparatus 12 to the automatic document feeding device 10 is discontinued by control circuits 18 and 112 as the main document belt drive 34 of the semi-automatic feeding mechanism 24 feeds the last document to exit tray 124.

The frame can be releasably fastened on the end of the main housing by conventional fastening elements, including sheet metal screws, machine screws and cooperating nuts, adhesives, clamps and the like.

It should be noted that the automatic sheet feeding device can feed various weights, surface finishes, styles, and sizes of sheet material including letter and legal size paper, envelopes, forms and the like. The single roller on each of the extending shafts can be replaced by two or more rollers.

It should also be understood that the automatic feeding device can be used in combination with sheet processing machines other than copiers, such as a printer or the like, having a sheet feeding or transport mechanism. In a printer, the sheets can be squared at the second set of rollers by use of a multiplicity of rollers on each of the shafts extending between the side plates of the frame. A cam and switch on one of the extending shafts can control the rollers/shaft combinations to run in reverse or stop, then restart the same to continue the feed.

Reference is now made to FIG. 19 which is similar to FIG. 1 but shows the automatic document feeder 10 with a different cover **44*a***, which is designed to facilitate manual document feeding.

FIG. 20 is a fragmentary top plan view of the machine of FIG. 19 with the cover 16 removed. As shown, the cover **44*a* is sloped to facilitate individual sheets to the copier while the automatic document feeder is still in place. Positioned beneath cover 44*a* is a switch 125 which is closed when the cover is down but opens when the cover is raised to deactivate or deenergize motor 60**.

Figure 21:
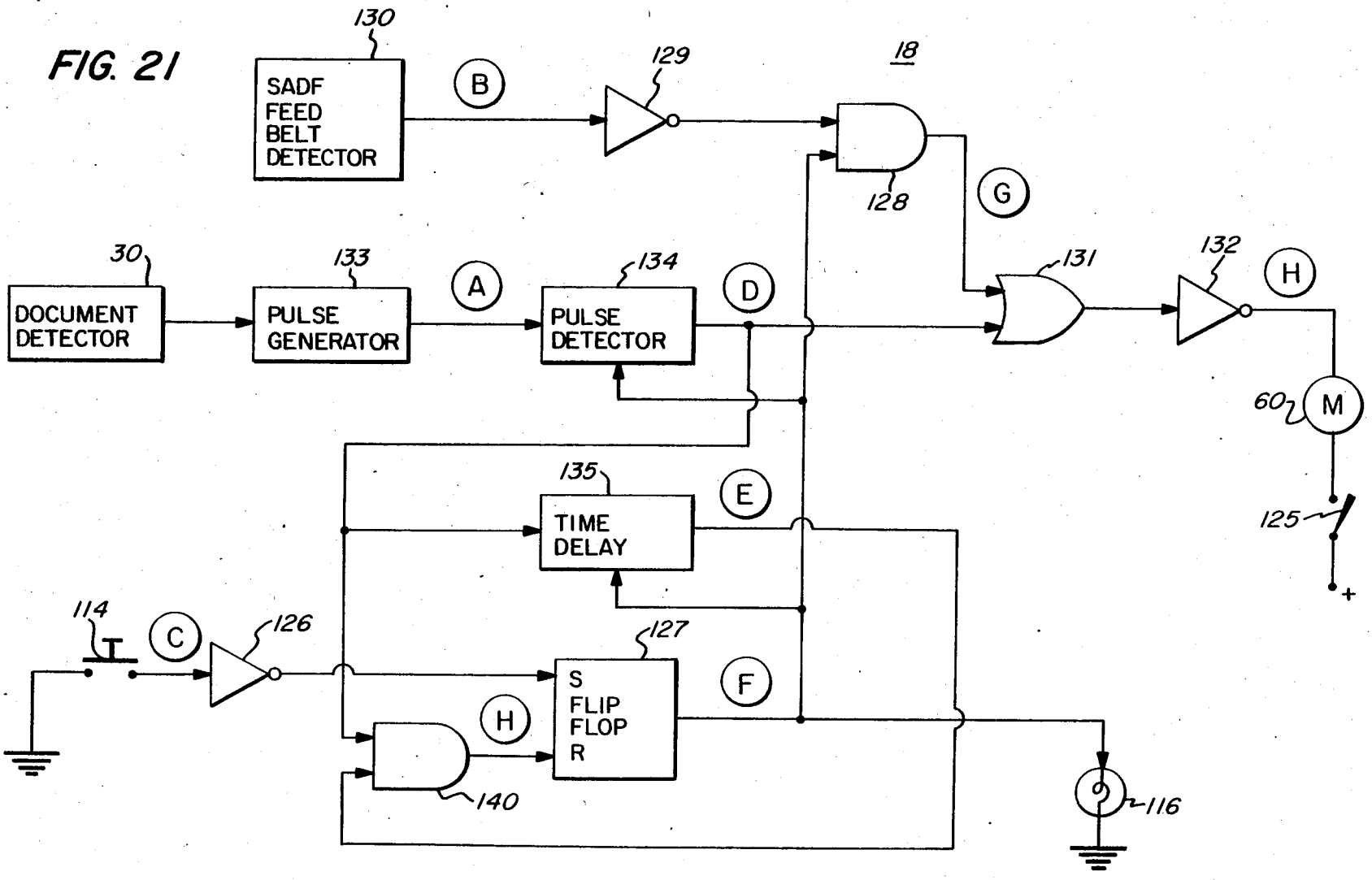
FIG. 21 is a diagram, partly in block and partly in schematic form, of circuit controlling operation of the automatic document feeder.
Figure 22:
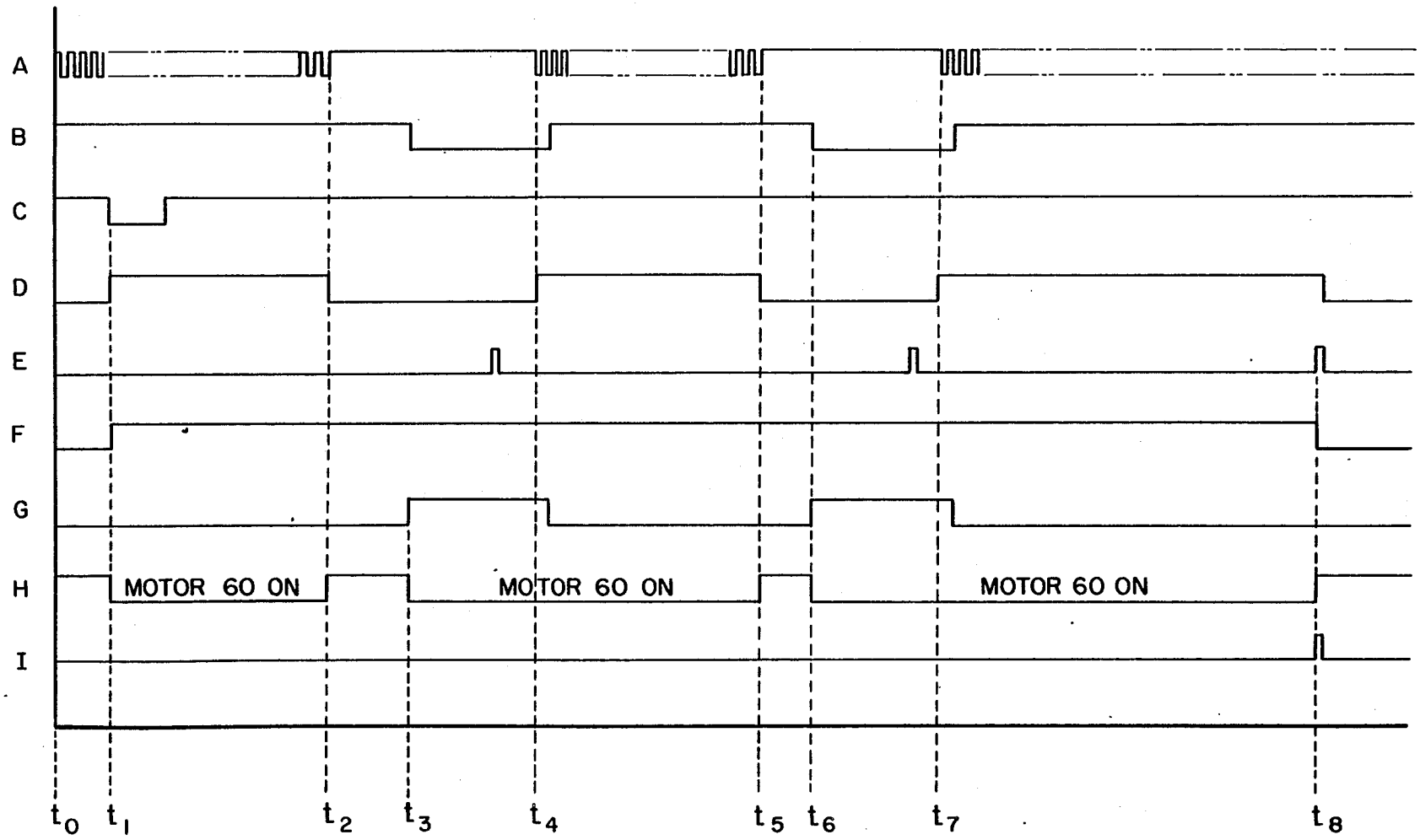
FIG. 22 is a diagram of signal waveforms occurring in the circuit of FIG. 21.

Reference is now made to FIG. 21 which exemplifies control circuit 18 and FIG. 22 which exemplifies signals appearing at points in circuit 18. The signals are referenced as A-I in both of FIGS. 21 and 22. To initiate operation of the automatic document feeder 10, switch 114 is closed and a low signal C applied to an inverter 126 which then sets a flip-flop memory 127. When set, memory 127 supplies a signal F to an AND gate 128. The AND gate also receives a signal B from an inverter 129 which receives a signal from the semi-automatic document feeder that the feed belt is working. The output G of AND gate 128 is applied through an OR gate 131 and inverter 132 as a signal H to energize motor 60. The motor now starts to operate to feed documents and will cyclically operate unless the cover **44*a* is lifted to open switch 125** or all documents to be copied have been fed.

When the first document reaches the entrance of the semiautomatic document feeder and is detected by sensor 30, sensor 30 supplies a signal to a pulse generator 133. Pulse generator 133 will supply pulses A at a predetermined rate, for example, seven hundred hertz to a pulse detector 134. Pulse detector 134 is enabled when memory 127 is in a set condition by signal F. Pulse detector 134 will supply a logic output if the signal from pulse generator 133 is present and memory 127 is set. The output of pulse detector 134 is also applied to a delay circuit 135. Delay circuit 135 is enabled by a set condition of memory 127. If, within a predetermined time after the automatic document feeder is turned on, a document is not sensed by the document detector 30, delay circuit 135 will supply a reset signal E and to reset flip-flop 127 deenergize motor 60.

Two signals are derived from the semi-automatic document feeder; that is, the signal A from paper detector 30 and a signal B indicative of the operation of the feed belt of the semiautomatic document feeder. This is normally a high level signal and goes to ground only when the semi-automatic document feeder is pulling a document into the coper. Such signal may be derived from the condition of the solenoid which raises and lowers the gate 32 and rollers 28.

Referring now to FIG. 22, at time $t_0$, the documents to be copied have been loaded into the automatic document feeder 10. At time $t_1$, start switch 114 is depressed. No document is detected by detector 30. Therefore, there is the pulse signal A from pulse generator 33. The motor 60 turns on as shown by signal H. The output of memory 127 is high, as indicated by signal F, and the output of pulse detector 134, signal D, goes high. Starting at time $t_1$, a document is now being fed to the semi-automatic document feeder. At time $t_2$, the document is detected by detector 30 and signal A becomes constant, that is, pulse generator 133 is turned off. At time t3, the semiautomatic document feed belt is operating, signal B indicating that the copier is now operating on the original to make photocopies. At this time, motor 60 of the automatic document feeder is again turned on, since the previous document is now in the copier.

As the trailing edge of the first document is detected by detector 30 at time t4, pulse generator 133 again becomes operative. At time t5, the leading edge of the second document is sensed by sensor 30. Signal A becomes constant. The output of pulse detector 134, signal D, goes low. The output of AND gate 128, signal G, is low; and motor 60 is turned off. At time t6, the feed belt of the semi-automatic document feeder is again operating and motor 60 is again turned on to feed the third sheet of paper.

Assume now that only two sheets of paper were in the document feeder. At time t7, pulse detector 134 detects the output of pulse generator 133 indicating that there is no paper sensed by detector 30 and the output goes high, signal D. After the predetermined delay occurs at time t8, delay circuit 135 provides a pulse output, signal E, together with signal D turn on AND gate 140 and resets flip-flop 127. This removes the signal F input to AND gate 128 and turns off motor 60. At this time, signal D is low. Thus, the system will detect when the documents to be fed have been exhausted and will automatically shut down.

Figure 23:
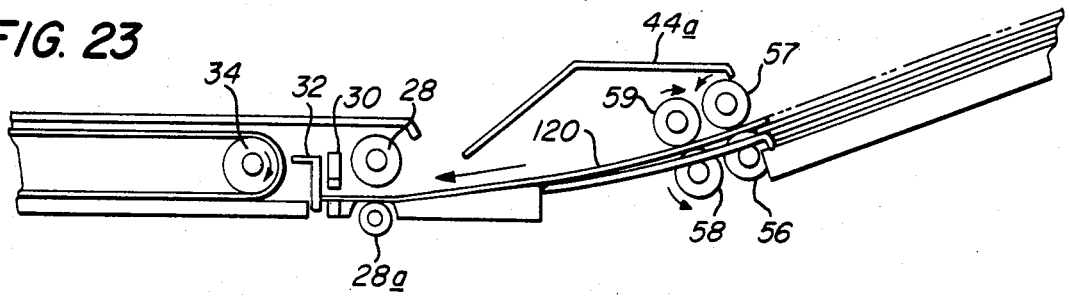
FIGS. 23–26 are fragmentary simplified side views of the automatic document feeder and a copier, which are helpful in illustrating the cooperation therebetween.

Reference is now made to FIG. 23, which schematically shows a sheet of paper 120 fed into the semi-automatic document feeder. At this point, gate 32 is down and feed roll 28 is raised above its mating pinch roll 28*a*. At this time, detector 30 will sense the leading edge of the sheet 120 and provide a constant signal A which causes motor 60 to turn off.

Figure 24:
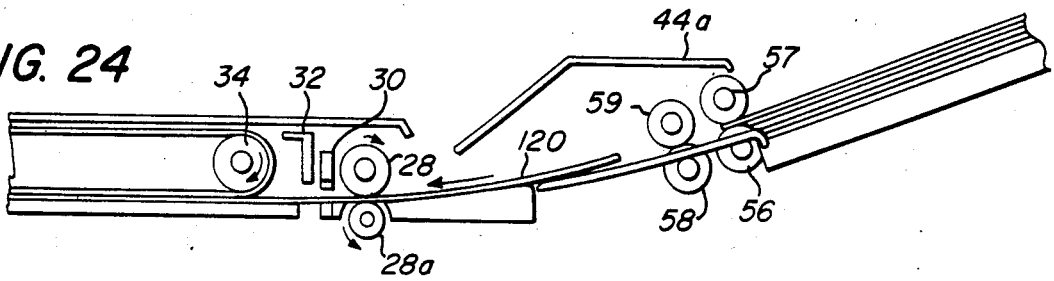

As shown in FIG. 24, the sensing of the leading edge of sheet 120 will cause gate 132 to be lifted and feed rollers 28 will move into engagement with the mating nip rollers 28*a* and the document 120 will be fed into the copier.

Figure 25:
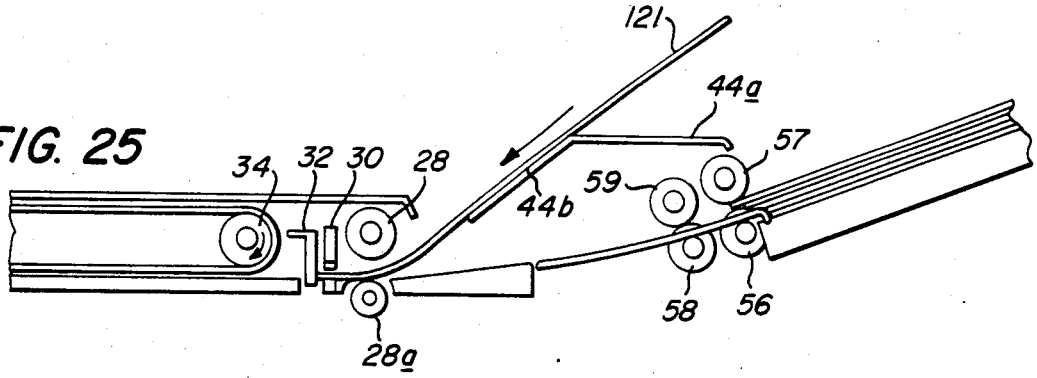
Figure 26:
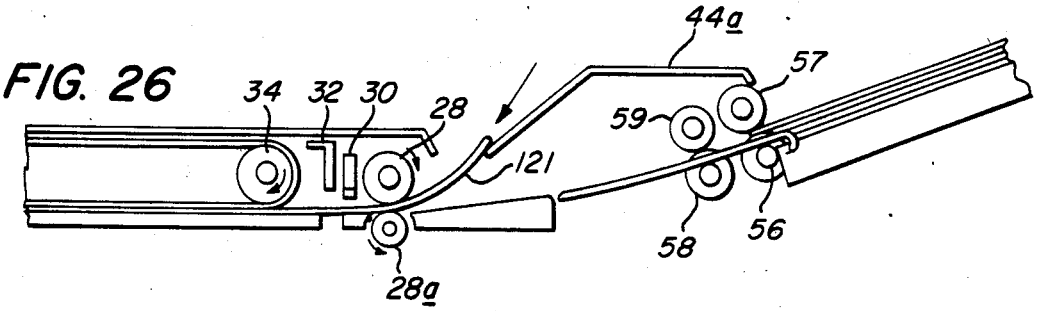

FIGS. 25 and 26 exemplifies a situation where it is desired to interrupt the automatic document feed to feed a single document 121. The cover 44*a* is lifted, opening switch 125, and the automatic document feeder is disabled. One then merely slides the document 121 down the inclined surface 44*b* of cover 44*a* to the gate 32 where the leading edge is sensed by detector 30. Gate 32 is lifted and rollers 28 are moved into engagement with the mating nip rollers 28*a* and the semi-automatic document feed belt is operated, as exemplified in FIG. 26.

It may thus be seen that the objects of the invention set forth, as well as those made apparent from the foregoing description, are efficiently attained. While a preferred embodiment of the invention has been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, we claim:

1. An automatic sheet feeder to feed and separate only the top sheet from a stack of sheets and feed that sheet to an independent sheet processing apparatus or the like where said sheet processing apparatus includes an entrance gate for positioning a sheet, a sheet detector for detecting a sheet at said gate, sheet feeding means, means for driving said sheet feeding means, said sheet processing apparatus including means responsive to said detector for lifting said gate and activating said sheet feeding means to feed a detected sheet to said processing apparatus, said automatic sheet feeder comprising:

(a) a frame including a pair of upstanding side plates mountable on said sheet processing apparatus;

(b) a sheet tray supported in said frame and adapted to hold a stack of sheets therein;

(c) sheet drive means supported on said frame for advancing a single sheet from a stack of sheets located on said sheet tray to said entrance position of said feeding mechanism, said sheet drive means including a set of upper and lower roller means cooperating to form a nip adjacent the lower edge of said sheet tray adapted to receive sheets of paper, said upper and lower roller means each including a shaft extending through and journaled for rotation in said side plates of said frame and at least one roller mounted thereon, roller drive means including a motor mounted on said frame for driving said roller means, and clutch means operatively connected between said lower roller means and said roller drive means, whereby said clutch means will drivingly engage said lower roller shaft when two or more sheets are fed simultaneously from said tray into said nip defined by said upper and lower roller means;

(d) means responsive to said sheet processing detector to energize said motor in response to operation of said sheet feeding means;

(e) a cover mounted in said frame for pivotal movement between a closed position and an open position to permit clearing of sheet jams;

(f) roller separating means on said frame cooperating with said cover and said roller shafts to separate said upper and lower roller means when said cover is pivoted from a closed position to an open position;

said roller separating means comprising:

i. an elongated aperture in said frame on one of said side plates;

ii. A slide plate having an inclined slot therein, said upper roller shaft being disposed in said elongated aperture and said inclined slot for movement therein to separate said upper and lower roller means; and iii. means operatively connecting said cover and said slide plate for moving said slide plate relative to said one side plate in response to pivotal movement of said cover, whereby said upper roller shaft will move upwardly in said inclined slot in response to said pivotal movement of said cover.

2. The combination in accordance with claim 1 wherein said sheet detector of said sheet processing apparatus is adjacent said gate to detect a sheet at said entrance position and signal circuit means of said automatic sheet feeding device to discontinue supply of power to said motor of said drive means when no sheet is detected at said gate for a predetermined time.

3. The combination in accordance with claim 1 wherein said entrance gate is mounted for vertical movement for blocking and releasing a sheet of material in said entrance position.

4. The combination in accordance with claim 3 wherein said upper roler means is mounted for vertical movement and is mechanically coupled to said entrance gate whereby said entrance gate and said upper roller means operate in unison.

5. The combination in accordance with claim 1 wherein said means for driving said upper roller means are mechanically coupled for simultaneous operation to feed a sheet from said entrance position through said processing station.

6. The combination in accordance with claim 1 wherein said sheet processing apparatus is a copying apparatus and said upper roller means, said entrance gate and said means for driving are mounted in a pivoted cover for a copying station.

7. The combination in accordance with claim 1 wherein said roller separating means further includes means biasing said end of said upper roller shaft towards said lower roller shaft to provide surface engagement between said rollers thereon.

8. The combination in accordance with claim 1 wherein said sheet drive means includes a second set of upper and lower roller means defining a nip spaced from said first set of roller means, said upper and lower roller means of said second set each including a shaft extending through and journalled for rotation in said side plates and having at least one roller thereon.

9. The combination in accordance with claim 8 wherein said second set of upper and lower roller means and said entrance position are spaced apart a distance less than the length between the trailing and leading edges of the sheets to be fed.

10. An automatic sheet feeder to feed and separate only the top sheet from a stack of sheets and feed that sheet to an independent sheet processing apparatus or the like comprising:

said sheet processing apparatus including a gate for positioning a sheet, a sheet detector for detecting a sheet at said gate, sheet feeding means, means for driving said sheet feeding means, said apparatus including means responsive to said detector for lifting said gate and activating said sheet feeding means to feed a detected sheet to said processing apparatus, said automatic document feeder comprising feed rollers arranged to deliver single sheets to said gate, a motor for driving said feed rollers, means responsive to operation of said sheet feeding means for energizing said motor, means responsive to said detector detecting a sheet at said gate for deenergizing said motor, and means responsive to lack of detection of a sheet by said sheet detector for a predetermined time for deenergizing said motor.

11. The combination of claim 10 further including a second set of driven rollers between feed rollers and said gate, said second set of driven rollers defining a nip to accept a sheet from said feed rollers and deliver an accepted sheet to said gate.

12. The combination of claim 11 wherein said second set of driven rollers are positioned with respect to said gate such that a sheet delivered to said gate by said second set of rollers will buckle between said gate and said second set of rollers prior to the sheet exiting said second set of rollers.

* * * * *